United States Patent [19]

Iten

[11] 4,180,907

[45] Jan. 1, 1980

[54] RAZOR WITH TRAP DOOR FEATURE FOR MAKING BLADE CHANGE

[75] Inventor: Clemens A. Iten, Staunton, Va.

[73] Assignee: American Safety Razor Company, Verona, Va.

[21] Appl. No.: 895,551

[22] Filed: Apr. 12, 1978

[51] Int. Cl.[2] ..... B26B 21/16

[52] U.S. Cl. ..... 30/64

[58] Field of Search ..... 30/38, 57, 64, 74

[56] References Cited

U.S. PATENT DOCUMENTS

| | | | |
|---|---|---|---|
| 1,530,331 | 3/1925 | Salerni | 30/64 |
| 2,682,105 | 6/1954 | Randol | 30/64 |
| 2,709,851 | 6/1955 | Randol | 30/57 |
| 2,715,268 | 8/1955 | Randol | 30/64 |
| 3,067,513 | 12/1962 | Randol | 30/74 |
| 3,605,265 | 9/1971 | Iten | 30/64 |

*Primary Examiner*—Gary L. Smith

*Attorney, Agent, or Firm*—Gajarsa, Liss & Conroy

[57] ABSTRACT

A razor in which a single edge razor blade is received in a blade platform member which member functions in the manner of a trap door, with the platform member in a first operative position holding the blade urged against blade stops in an operative shaving position, but which member can be moved to a second position in which the blade is released for removal from the razor.

17 Claims, 7 Drawing Figures

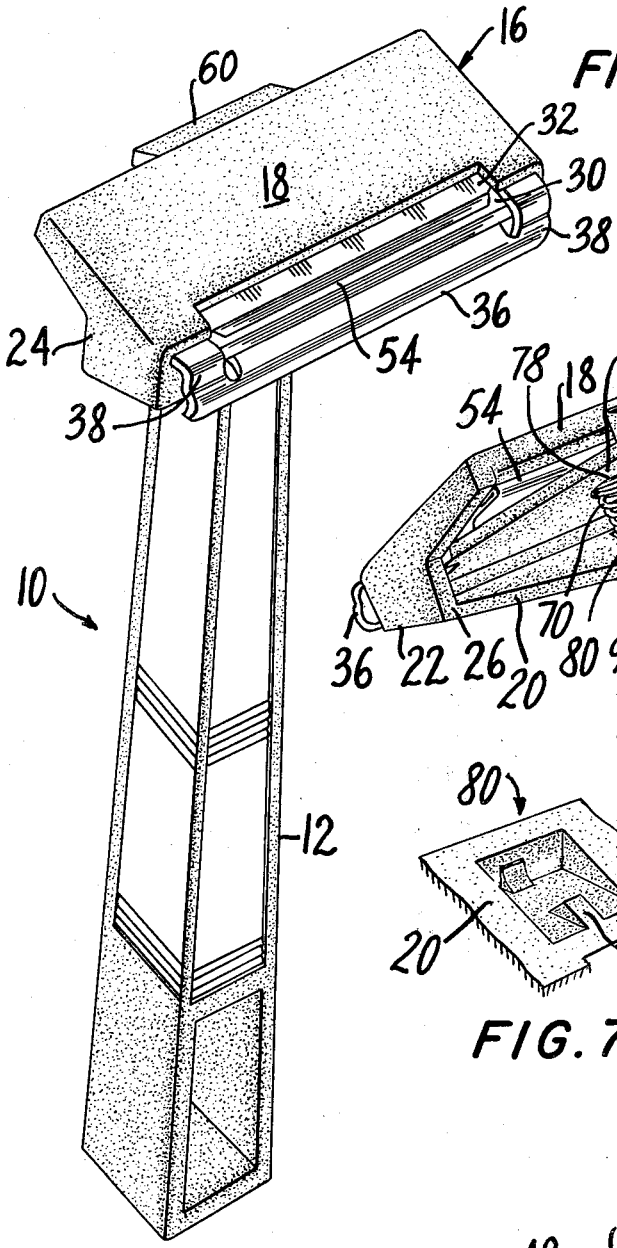
FIG. 1
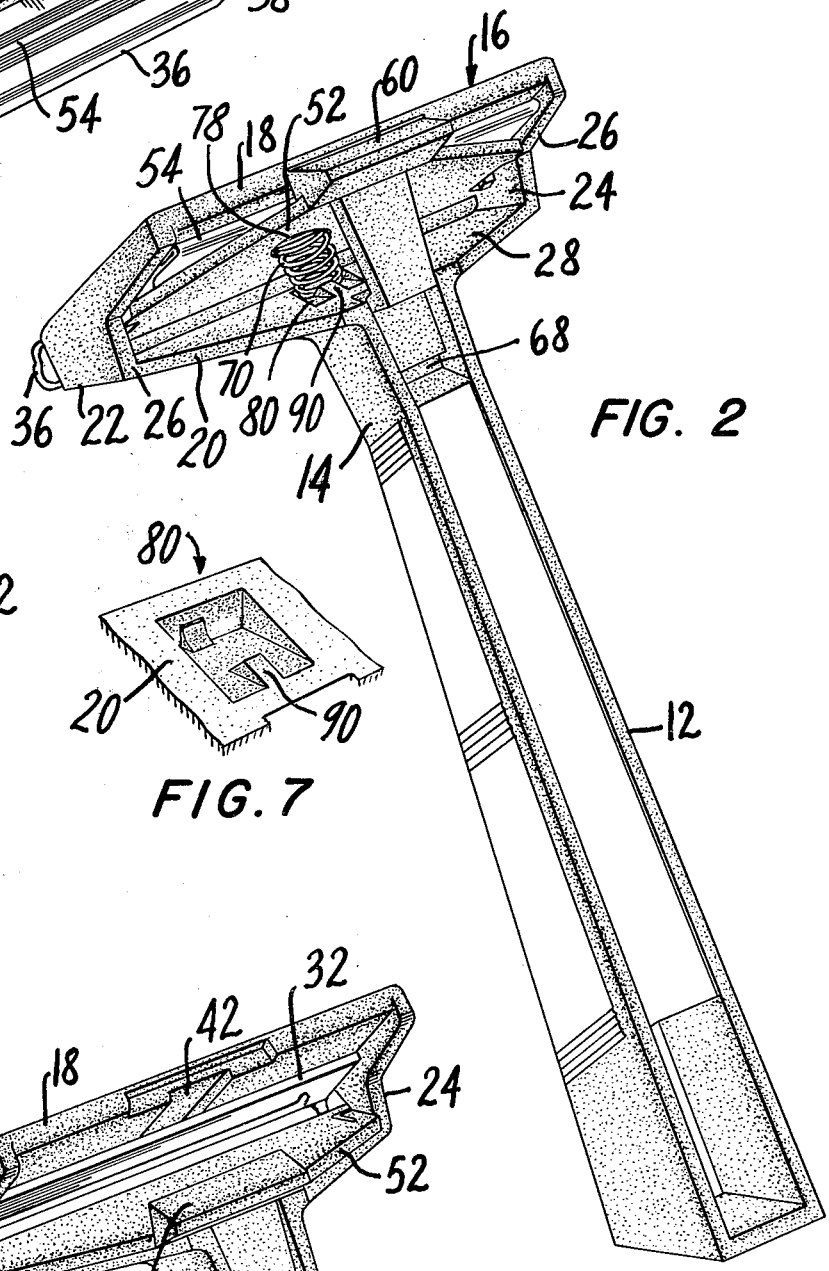
FIG. 2
FIG. 7
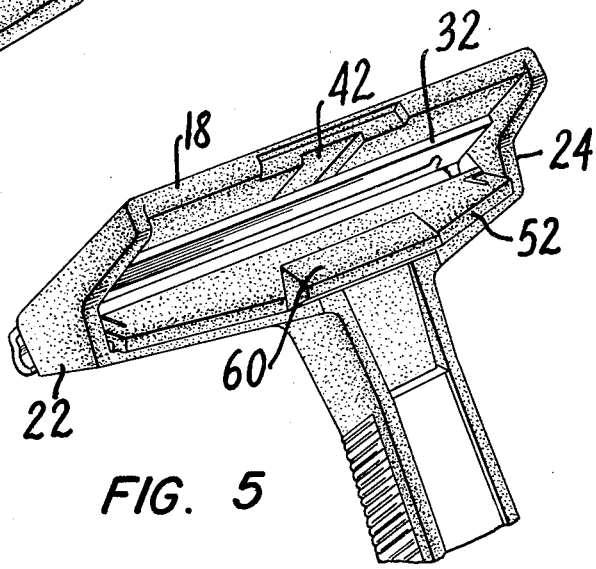
FIG. 5

RAZOR WITH TRAP DOOR FEATURE FOR MAKING BLADE CHANGE

BACKGROUND OF THE INVENTION

The present invention relates to a razor for use with the so-called "GEM" type single edge razor blade, such form of razor blade being well known in the art and having a single cutting edge at one side edge and a thickened band component embracing marginal portions of the other or rear edge of the blade.

SUMMARY OF THE INVENTION

The present invention relates to an easily and economically manufactured shaving razor for use with single edge blades of the "GEM" type. The razor is lightweight and the handle and shaving head component thereof can be formed as a molded one-piece unit and the remaining components making up the razor structure are likewise of simple construction and hence readily manufactured on a mass production basis. In total, the razor can be manufactured quickly and cheaply and the respective components assembled with a minimum of labor and assembly involvement.

In accordance with the present invention, the razor includes an elongated handle which can be provided in any one of a number of cross-sectional shapes, with the handle deminishing the thickness from the bottom towards the top or shaving head end thereof. The shaving head which desirably is formed integrally with the handle comprises an enclosure which extends laterally of the handles and opposite sides thereof and includes upper and lower wall segments which are spaced apart so as to define an opening at the front side of the enclosure and a similar opening at the rear of the enclosure, with there being end wall segments extending between the upper and lower wall segments. In a preferred form, the upper and lower wall segments converge toward each other in a direction from rear to front of the enclosure. A blade guard member is fixed in the enclosure adjacently below the upper wall segment, the end wall segments of the enclosure being provided with slots which receive opposite end portions of the blade guard member, with the blade guard member having a plate-like main body part and a forward or frontally directed portion which extends through the front opening of the enclosure and terminates in a soap bar of conventional construction, the soap bar being spaced outwardly a distance from the enclosure front opening. Blade stop means are in the usual manner provided at opposite ends of the soap bar.

A blade platform member is carried in the enclosure and is provided with a substantially flat main body and a pair of oppositely directed pivots adjacent the front edge thereof, with such oppositely directed pivots being received in pivot guide steps formed in the enclosure end wall segments adjacent the front opening, such pivot guide steps cooperating with an upward extension of the front wall to define a blade platform member movement and retention means in the enclosure. The pivot guide steps slope downwardly and rearwardly from the front opening so that the blade platform member can be moved between two operative positions in the fashion of a trap door, the movement being a combined form of sliding and pivoting of the platform member. In the first operative position, the platform member upon which is received the razor blade, urges the razor blade upwardly against the guard member and forwardly through the enclosure front opening against the blade stop means. In the second operative position of the platform member, the same rests upon the enclosure bottom wall segment and in such operative position full access to the interior of the enclosure is available for making a blade change. Resilient means in the form of a coil spring is provided for maintaining the platform member normally in its first operative position, with the spring engaging the enclosure bottom wall segment and the underside of the platform member. The spring is preferably engaged by a lug, molded into the lower wall segment, possibly at a recess thereof. For the purpose of holding the platform member in its second operative position as when blade change is being made, detent means is provided for locking or securing the platform member in its said second position. Said detent means include a latching lug at the rear side of the platform member which extends below the platform member and which, when said platform member is moved to its second operative position, engages in a detent groove formed in the upper portion of the handle. The latch member also includes a camming projection which extends above the main body of the platform member and has a camming surface which inclines downwardly and forwardly relatively of the platform member, such camming surface engaging the rear or banded edge of the razor blade when the platform member is in its first position for maintaining the blade in its shaving position in the enclosure.

Conveniently and desirably, the enclosure and handle as indicated are made as a single molded one-piece structure from various types of thermoplastic material.

The invention accordingly comprises the features of construction, combination of elements and arrangement of parts, which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which:

FIG. 1 is a perspective view of a razor constructed in accordance with the principles of the present invention, as viewed from the front or shaving side thereof.

FIG. 2 is a perspective view of the razor shown in FIG. 1 as viewed from the rear thereof, the blade platform member being shown in its first operative position wherein it urges the razor blade forwardly against the blade stops in shaving position.

FIG. 5 is a fragmentary perspective view of the razor as viewed from the rear showing the blade platform member or trap door in its second operative position as when a blade change is being made, there being no blade in the razor.

FIG. 7 is a fragmentary perspective view of a recess for maintaining a spring in the invention.

Throughout the description like reference numerals are used to denote like parts in the drawings.

DESCRIPTION OF THE PREFERRED EMBODIMENTS

As indicated before, the present invention is concerned with an economically and easily manufactured razor for use with single edge blades of the "GEM" type although it can be used with any similar type of single edge blade. It can be made of various forms of thermoplastic material such as acrylics, nylon, polyethelene and the like. Thus, the shaving head enclosure handle and blade platform member can be molded from thermoplastic materials, it being only necessary to employ a metal such as brass for the blade guard member. The coil spring which is used for normally urging the blade platform member into its first operative position can be made from any one of a number of materials suited for that purpose. Thus, the razor comprises only four simply and inexpensively manufactured components but at the same time holds and locates the shaving blade in such manner as to provide for smooth and comfortable shaving therewith and convenient blade replacement when necessary.

Figure 3:
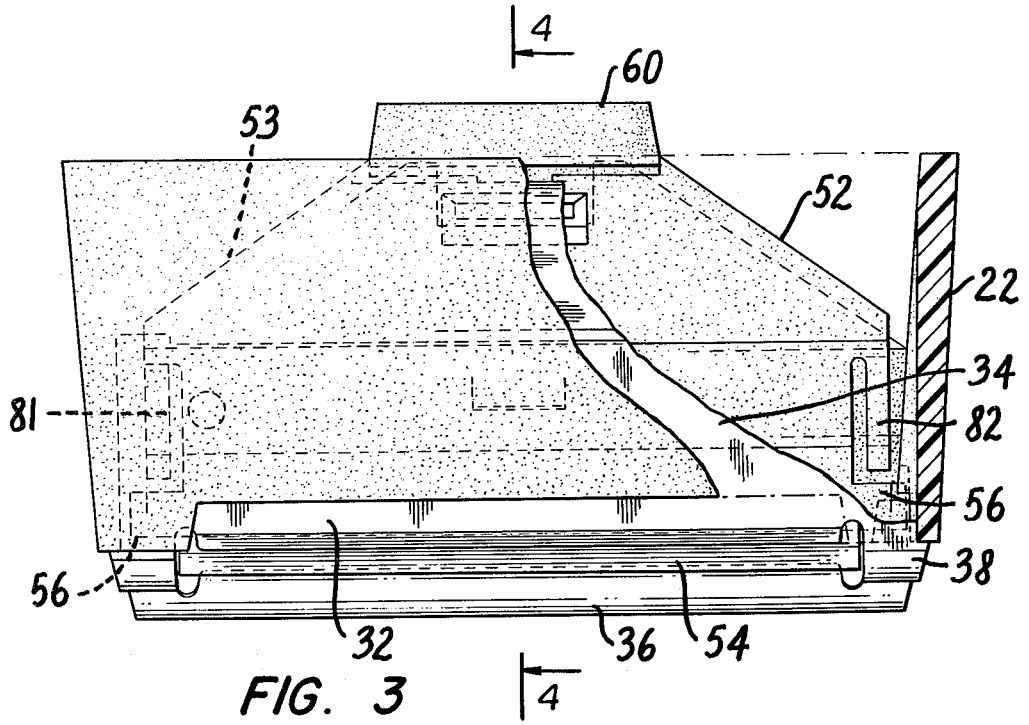
FIG. 3 is a top plan view of the razor, portions thereof being broken away for purposes of depiction of various constructional aspects of the invention.
Figure 4:
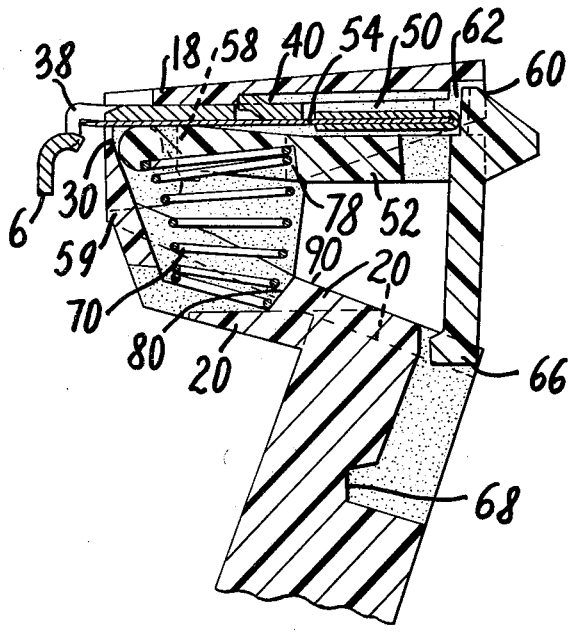
FIG. 4 is a vertical sectional view as taken along the cutting line 4—4 in FIG. 3, the blade platform being shown in its first operative position.
Figure 6:
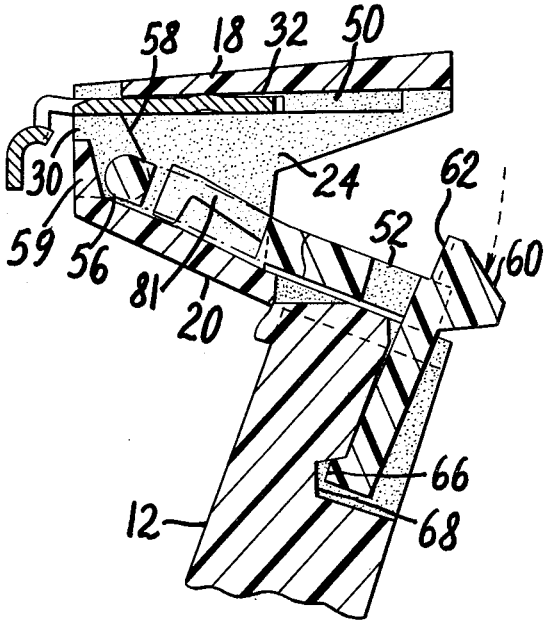
FIG. 6 is a fragmentary vertical sectional view of the razor shaving head (without a blade being in place) when the platform member is moved to its second operative position showing the manner in which the latching lug engages the detent groove of the handle for maintaining said platform member in the second operative position.

Turning now to consideration of the razor construction, and with reference to FIGS. 1 and 2, the razor 10 includes an elongated handle part 12 which is shown as being in preferred form of generally rectangular cross section, the cross section diminishing uniformly from bottom to top so as to provide a relatively thin segment 14 where the handle merges with the shaving head enclosure 16. The handle 12 and the shaving head 16 preferably are formed of unitary construction being of readily moldable character. The shaving head enclosure 16, as will be noted, includes upper and lower wall segments 18 and 20, respectively, and between which extend end wall segments 22 and 24, the end wall segments having cut away portions at the rear side as at 26. The upper and lower wall segments 18, 20 of the enclosure converge toward each other in a direction from rear to front of the enclosure and define therebetween a rear opening 28 and a front opening 30 in the enclosure. Located within the enclosure 16 is a blade guard member 32 which includes a plate-like main body part 34 and a frontally directed extension which passes through the front opening 30 of the enclosure and terminates in a soap bar or guard member 36 of conventional construction, the soap bar being provided at opposite ends with blade stop means 38. The blade guard member 32 as will be noted particularly from FIGS. 4 and 6 is provided with a dimple 40 at the mid body thereof which dimple is received in a groove 42 formed at the underside of the upper wall segment 18 of the enclosure and serves to retain or lock the guard member in the shaving head. Also, for securing or fixedly retaining the blade guard member in the enclosure, the end wall segments 22, 24 of the enclosure are provided at their inner side with slots 50 in which are received marginal portions of the opposite ends of the main body part 34 of the guard member. In making the razor, the blade guard member 32 can be located and fixed in the molding equipment in various ways, e.g., the enclosure can be molded around the same. Preferably, however, the guard member 32 is inserted through front opening 30 of the enclosure and for which purpose wall 18 can be flexed to allow dimple 40 to pass until it reaches and snaps in groove 42.

The razor 10 also includes a blade platform member 52 upon which is received a razor blade 54 of the "GEM" type. The blade platform member 52 which functions in the fashion of a trap door is provided at the front with a pair of oppositely directed pivots 56 which are received loosely in guide steps 58 formed in the enclosure at the side thereof, the guide steps being disposed adjacent the front opening 30 of the enclosure and sloping downwardly and rearwardly as shown, as best seen in FIGS. 4 and 6. The guide steps 58 cooperate with the inner surface of the upwardly directed front wall extension 59 of the enclosure to captively hold the platform member in the enclosure. The front wall extension 59 extends across a substantial expanse of the front of the enclosure but the ends thereof terminate spaced a distance from the respective end wall segments. Thus the pivots 56 and hence platform member 52 are captively movable in a combined sliding-pivoting movement for moving the platform member between its first operative position as shown for example in FIG. 2, to its second operative position as for example as shown in FIGS. 5 and 6.

When the blade platform member 52 is in its first operative position as seen in FIG. 4, the platform member urges the razor blade 54 upwardly against the guard member 32 and forwardly through front opening 30 and against the stop means 38. For effecting such positioning of the blade in shaving position, the blade platform member 52 is provided at the rear side thereof with a camming projection 60 which extends above the flat main body part 53 of the platform member and such camming projection 60 engages the rear edge of the blade as shown, with the camming projection having a camming surface 62 which inclines downwardly and forwardly of the blade platform member. The blade platform member is also provided with a latching lug 66 which together with a groove 68 formed in the handle 12 provides a detent means for maintaining the blade platform member in its second operative position as shown in FIG. 6 when it is desired to make blade change, and when the blade platform member is moved downwardly in the fashion of a trap door against the action of coil spring 70, the coil spring serving the function of normally maintaining the blade platform member in its first operative position.

Both the lower wall segment 20 of the enclosure and the underside of the blade platform main body 53 are provided with recesses 80 in which are received opposite ends of the coil spring. Moreover, the blade platform includes fingers 81, 82 which function to prevent blade edge damage when the blade is inserted in the razor and when it is moved to shaving position.

FIG. 7 illustrates one embodiment of the recess 84 containing the lower end of spring 70. Specifically, a hollowed recess may be formed during the molding process, with lug 90 being molded therein, in order to provide a retaining means for the spring. Such a retaining means may prevent the spring from leaving the recess, for example.

While there is disclosed above but one embodiment of the razor of the invention, it is possible to produce still other embodiments without departing from the scope of the inventive concept herein disclosed, and accordingly it should be understood that all matter contained in the above description are shown in the accompanying drawings and should be interpreted as illustrative and not in a limiting sense.

I claim:

1. A razor including an elongated handle, and a shaving head connected to one end of said handle, said shaving head comprising an enclosure extending laterally of said handle at opposite sides thereof and including upper and lower wall segments spaced apart so as to define openings at the front and rear of said enclosure, a blade guard member fixed in said enclosure adjacently below said upper wall segment and having a frontally directed portion extending through the front opening of said enclosure and terminating in a soap bar spaced outwardly a distance from said front opening, there being blade stop means at opposite ends of said soap bar, a blade platform member carried in said enclosure, a razor blade having a sharpened cutting edge received on said platform member, said platform member being pivotally and slidably movable in said enclosure between a first operative position and a second position, said first position being forwardly and upwardly displaced from said second position, said platform member resting on said enclosure bottom wall segment in said second position, said platform member moving said razor blade forwardly and upwardly while slidably and pivotably moving from said second to said first position, said platform member urging said razor blade forwardly through said enclosure front opening against said blade stop means, and upwardly against said guard member in said first operative position, resilient means engaging said enclosure bottom wall segment and said platform member and normally urging said platform member into its first operative position, and detent means operable when said platform member is moved to its second position to hold said platform member in said second position in opposition to the action of said resilient means.

2. The razor of claim 1 in which said enclosure further includes end wall segments extending between said upper and lower wall segments, said blade guard member including a plate-like main body part fixed to said end wall segments.

3. The razor of claim 2 in which the end wall segments are provided with guiding means structure, portions of opposite ends of said platform member being engageable with said guide means structure for guiding said platform member during movement of same between its first and second positions.

4. The razor of claim 2 in which the enclosure is of unitary one-piece construction, the said upper and lower wall segments thereof converging toward each other in a direction from rear to front of said enclosure.

5. The razor of claim 1 in which said blade platform member has a substantially flat main body and is captively movably carried in said enclosure.

6. The razor of claim 5 in which said platform member is provided with a pair of oppositely directed pivots, said pivots being engageable with guide steps formed in said enclosure, said guide steps being disposed adjacent the opening at the front of said enclosure and extending downwardly and rearwardly from said enclosure top wall segment, said pivots being captively moveable in a guide slot defined by said guide steps and an upwardly directed front wall part of said enclosure when said platform member is moved between said first and second operative positions thereof and vice-versa.

7. The razor of claim 6 in which said platform member includes a latch member at the rear side thereof, said latch member including a camming projection extending above the flat main body of said platform member, said camming projection engaging the rear edge of said razor blade and urging said razor blade forwardly against the blade stop means when said platform member is in its first operative position.

8. The razor of claim 7 in which said camming projection has a camming surface inclining downwardly and forwardly relatively of said platform member.

9. The razor of claim 7 in which the detent means comprises a latching lug as an extension of said latch member, said handle having a detent groove in which said latching lug engages when said platform member is moved to its second operative position.

10. The razor of claim 1 in which said resilient means is a coil spring.

11. The razor of claim 10 in which said platform member and said enclosure bottom wall segment are provided with recesses in which opposite ends of said coil spring are received.

12. The razor of claim 11 wherein one of said recesses comprises a means for retaining said coil spring in said recess.

13. The razor of claim 12 wherein said retaining means comprises a lug molded integrally with said enclosure.

14. The razor of claim 2 in which the upper and lower wall segments of said enclosure are of unitary, molded thermoplastic material construction.

15. The razor of claim 14 in which said handle and said enclosure are of molded integral construction.

16. The razor of claim 1 wherein said platform member comprises a camming surface for engaging and urging forwardly a rear edge of said razor blade.

17. The razor of claim 16 wherein said camming surface inclines downwardly and forwardly relative to said platform member.

* * * * *